US008267564B2

(12) United States Patent
Kim et al.

(10) Patent No.: US 8,267,564 B2
(45) Date of Patent: Sep. 18, 2012

(54) LIGHT EMITTING STRUCTURE FOR BACKLIGHTED SIGN

(75) Inventors: Seungho Kim, Vienna, VA (US); Kiwon Kang, Anyang (KR)

(73) Assignee: Knowledge Society Integration Co., Ltd., Anyang (KR)

( * ) Notice: Subject to any disclaimer, the term of this patent is extended or adjusted under 35 U.S.C. 154(b) by 197 days.

(21) Appl. No.: 12/874,842

(22) Filed: Sep. 2, 2010

(65) Prior Publication Data

US 2012/0057369 A1 Mar. 8, 2012

(51) Int. Cl.
*F21V 7/04* (2006.01)

(52) U.S. Cl. ..... 362/616; 362/97.3; 362/249.02; 362/612

(58) Field of Classification Search ..... 362/97.1–97.4, 362/249.02, 612, 616, 800
See application file for complete search history.

(56) References Cited

U.S. PATENT DOCUMENTS

| | | | |
|---|---|---|---|
| 6,023,869 | A | 2/2000 | Durbin |
| 6,530,164 | B2 | 3/2003 | Gai |
| 2004/0095741 | A1 | 5/2004 | Chen |
| 2007/0245607 | A1 | 10/2007 | Awai et al. |
| 2009/0019752 | A1 | 1/2009 | Liao |
| 2010/0073905 | A1 | 3/2010 | Hsin-Nung |
| 2010/0101127 | A1 | 4/2010 | Chen |

FOREIGN PATENT DOCUMENTS

| | | | |
|---|---|---|---|
| JP | 2003-330394 | A | 11/2003 |
| JP | 2006-160136 | A | 6/2006 |
| JP | 2009-163016 | A | 7/2009 |
| KR | 10-0587834 | B1 | 6/2006 |
| KR | 10-2008-0006736 | A | 1/2008 |
| KR | 10-0838332 | B1 | 6/2008 |
| KR | 20080063736 | A | 7/2008 |
| KR | 10-0817870 | B1 | 8/2008 |
| KR | 10-2008-0094432 | A | 10/2008 |
| KR | 20-2009-0009556 | U | 9/2009 |
| KR | 10-2009-0116882 | A | 11/2009 |
| KR | 10-2009-0123189 | A | 12/2009 |
| KR | 20090123189 | A | 12/2009 |

*Primary Examiner* — Jason Moon Han
(74) *Attorney, Agent, or Firm* — Rothwell, Figg, Ernst & Manbeck, P.C.

(57) ABSTRACT

There is provided a light emitting assembly for a backlighted sign. The assembly may include first and second light emitting units configured to emit light in corresponding first and second directions into edges of first and second adjacent light guide plates. The assembly may also include a third light emitting unit configured to emit light in a direction substantially transverse to the first and second directions into a backlightable sign panel. Light emitting units are slidably insertable and slidably removable.

8 Claims, 6 Drawing Sheets

-- PRIOR ART --

-- PRIOR ART --

LIGHT EMITTING STRUCTURE FOR BACKLIGHTED SIGN

BACKGROUND OF THE INVENTION

1. Field of the Invention

The present invention relates to illuminated signs such as backlighted signs having an information or visual content bearing front panel with translucent and/or transparent portions through which backlighting may be perceived. The present invention relates to configurations and layouts of backlighting elements for such signs.

2. Description of the Related Art

Generally a sign or advertisement board may be formed by printing characters and/or images or attaching printed material on the surface of a metallic plate or a synthetic resin plate. However, such advertisement boards have low visual recognition in daytime and worse visual recognition at night and in snowy, rainy and foggy weather conditions, such that an observer, such as a vehicle driver or passenger, cannot easily recognize the sign's information content.

With reference to FIGS. 1A and 1B, a conventional backlighted illuminated advertisement board 40 may have one or more light guide plates 10 and light emitting diode (LED) units 20 installed behind a sign panel 50. LED units 20 are affixed to direct light into the edge of an adjacent light guide plate 10 which redirects the light into its surface and sign panel 50 so that the light may be transmitted through transparent or translucent portions of sign panel 50 and observed by an observer. In this way, visibility and recognition of information content of board 40 is possible in bad weather and at night.

However, such conventional boards suffer from uneven illumination in which light does not reach central portions, especially with larger advertisement boards. For example, area 55 of sign panel 50, not positioned directly above a light guide plate, may not receive the same amount of backlighting as the remainder of sign panel 50. Observers are unable to recognize the visual content of such portions of conventional advertisement boards. Such conventional signs may also have a visible dark seam corresponding to the location of adjacent light guide plates. Moreover, the conventional board is not constructed for ease of replacement of LED units.

BRIEF SUMMARY OF THE INVENTION

Accordingly, it is an object of the present invention to provide a light emitting structure for an illuminated sign which overcomes the problems encountered in the conventional art.

It is another object of the present invention to provide a light emitting structure for a backlighted sign which is capable of uniformly emitting light to all portions of a sign panel by providing interior light emitting units capable of emitting light in a T-shape, upwardly into a center portion and laterally into one or more light guide plates, so that it is possible to more fully illuminate the information on the sign and render it recognizable to observers.

In addition, light emitting units according to the present invention may be slidably insertable and slidably removable between a frame and a light guide plate or between light guide plates, so that light emitting units may be easily exchanged when damaged or needing maintenance.

In accordance with an embodiment of the invention, there is provided a light emitting assembly for a backlighted sign. The assembly includes first and second light emitting units configured to emit light in corresponding first and second directions into edges of first and second adjacent light guide plates and a third light emitting unit configured to emit light in a direction substantially transverse to the first and second directions and into a backlightable sign panel.

In some embodiments, the light emitting assembly may include the first adjacent light guide plate and the second adjacent light guide plate. In some embodiments, at least one of the first, second and third light emitting units comprises light emitting diodes. In some embodiments, at least one of the first, second and third light emitting units is slidably insertable into the assembly. In some embodiments, the light emitting assembly includes transparent molding disposed on at least one of the light emitting units, the molding arranged to prevent water ingress upon electrical components of the light emitting unit and being composed of transparent epoxy or a silicone-based compound. In some embodiments, a light emitting unit comprises a heat sink and the transparent molding is disposed therein. In some embodiments, the heat sink has a U-shaped profile.

In some embodiments, the light emitting assembly includes a heat sink with a substantially U-shaped profile. The first and second light emitting units are disposed on opposite sides of the heat sink and, for any given cross-section, are oriented to direct light in opposite directions. The third light emitting unit is disposed within the heat sink and is oriented to direct light toward the opening of the heat sink. In some embodiments, the light emitting assembly further includes a transparent cover disposed along the sides and over the opening of the heat sink with a substantially U-shaped profile, the transparent cover being configured to transmit light emitted from the third light emitting unit.

According to yet other embodiments, there is provided a backlighted sign having the light emitting assembly discussed above, first and second adjacent light guide plates, and a backlightable visual content panel. Light emitting units have installed positions in which they are disposed between the first and second adjacent light guide plates and behind the backlightable visual content panel and are slidably insertable and slidably removable from the installed position. The backlighted sign may further comprise a frame and one or more edge light emitting assemblies configured and arranged to emit light into at least one edge of the first and/or second adjacent light guide plates.

The above and other aspects and embodiments are described below with reference to the accompanying drawings.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements.

DETAILED DESCRIPTION OF THE INVENTION

Figure 1A:
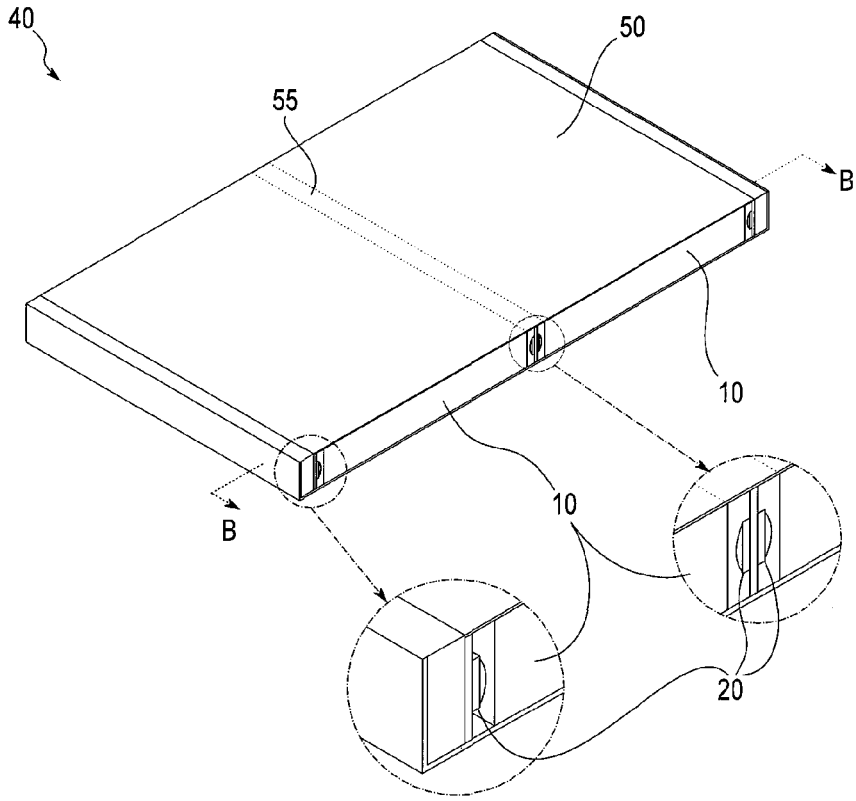
FIGS. 1A and 1B illustrate a perspective view and detail insets and a sectional view, respectively, of a prior art illuminated sign apparatus.
Figure 1B:
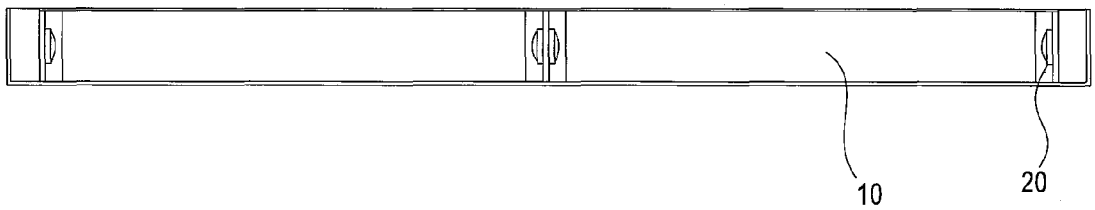
Figure 2:
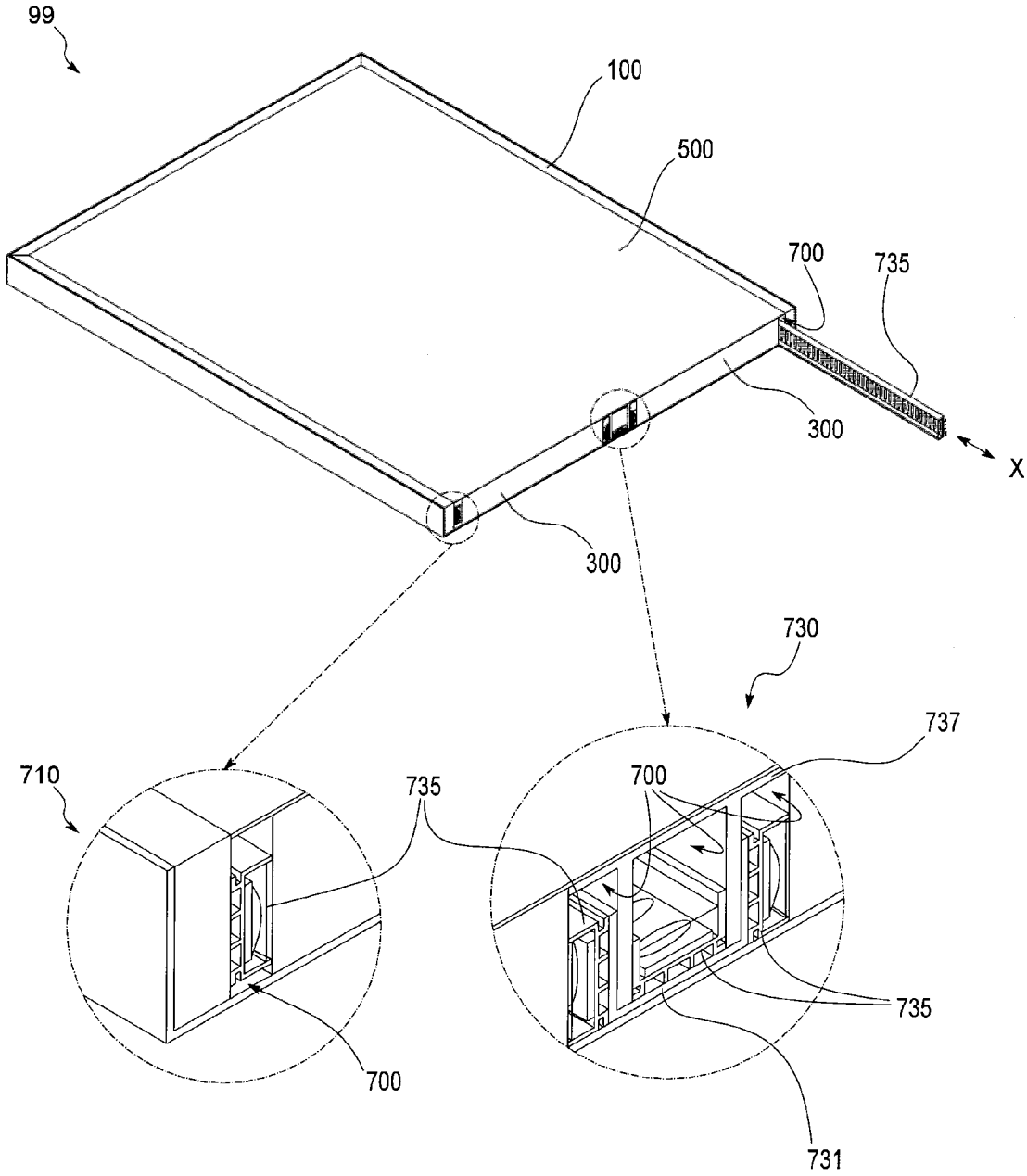
FIG. 2 illustrates a perspective view and detail insets of an illuminated sign apparatus in accordance with embodiments of the invention.

Referring to FIG. 2, according to an embodiment of the present invention, a structure for a backlighted sign 99 is provided. The structure may include a frame 100, light emitting unit insertion areas 700 with light emitting units 735 inserted therethrough, light guide plates 300 and visual content sheet 500 disposed on surfaces of light guide plates 300. Light guide plates 300 may be configured to direct light from an edge thereof to a surface thereof.

In one embodiment, frame 100 is made of a metallic material or a reinforced plastic material for preventing the frame from being damaged by means of an external impact. The size of frame 100 is generally dependent on the size of the sign to be manufactured.

One or more light guide plates 300 are disposed in the interior of the frame 100 and are configured to direct light incident on one or more edges thereof from light emitting units 735 to a surface of light guide plate 300, so that the visibility of the information of visual content sheet 500 is enhanced. The number of light guide plates 300 for a particular backlighted sign is determinable by the size of visual content sheet 500, the brightness of light emitting units 735, the efficiency of light guide plates 300 and the desired brightness of board 99. Space is maintained between adjacent light guide plates 300 and between a light guide plate 300 and frame 100 so that light emitting units 735 may be slidably inserted and slidably removed through light emitting unit insertion areas 700. In FIG. 2, the right-edge light emitting unit 735 is slidable on axis X and is shown partially inserted.

Visual content sheet 500 is disposed on the surfaces of light guide plates 300. Visual content sheet 500 may be an advertisement sheet. Visual content sheet 500 may include variously transparent and/or translucent portions in one or more colors, such that the portions form images and characters having visual information content. Visual content sheet 500 is preferably made of a transparent synthetic resin.

Light emitting units 735 may be positioned along a sign edge as shown in detail 710 and/or in interior areas as shown in detail 730. Light emitting units 735 comprise one or more light sources such as light emitting diodes (LEDs) and may also include one or more heat sinks as further discussed below. As shown in detail 710, at an edge portion of the backlighted sign, e.g., adjacent to frame 100, a light emitting unit 735 may be arranged to direct light into a light guide plate 300 to redirect light to a surface of the light guide plate 300 for backlighting visual content sheet 500. As further illustrated in detail 730, in an interior portion of the backlighted sign, e.g., between neighboring light guide plates 300, interior light emitting units 735 are configured to emit light both into adjacent light guide plates 300 and into visual content sheet 500.

Figure 3:
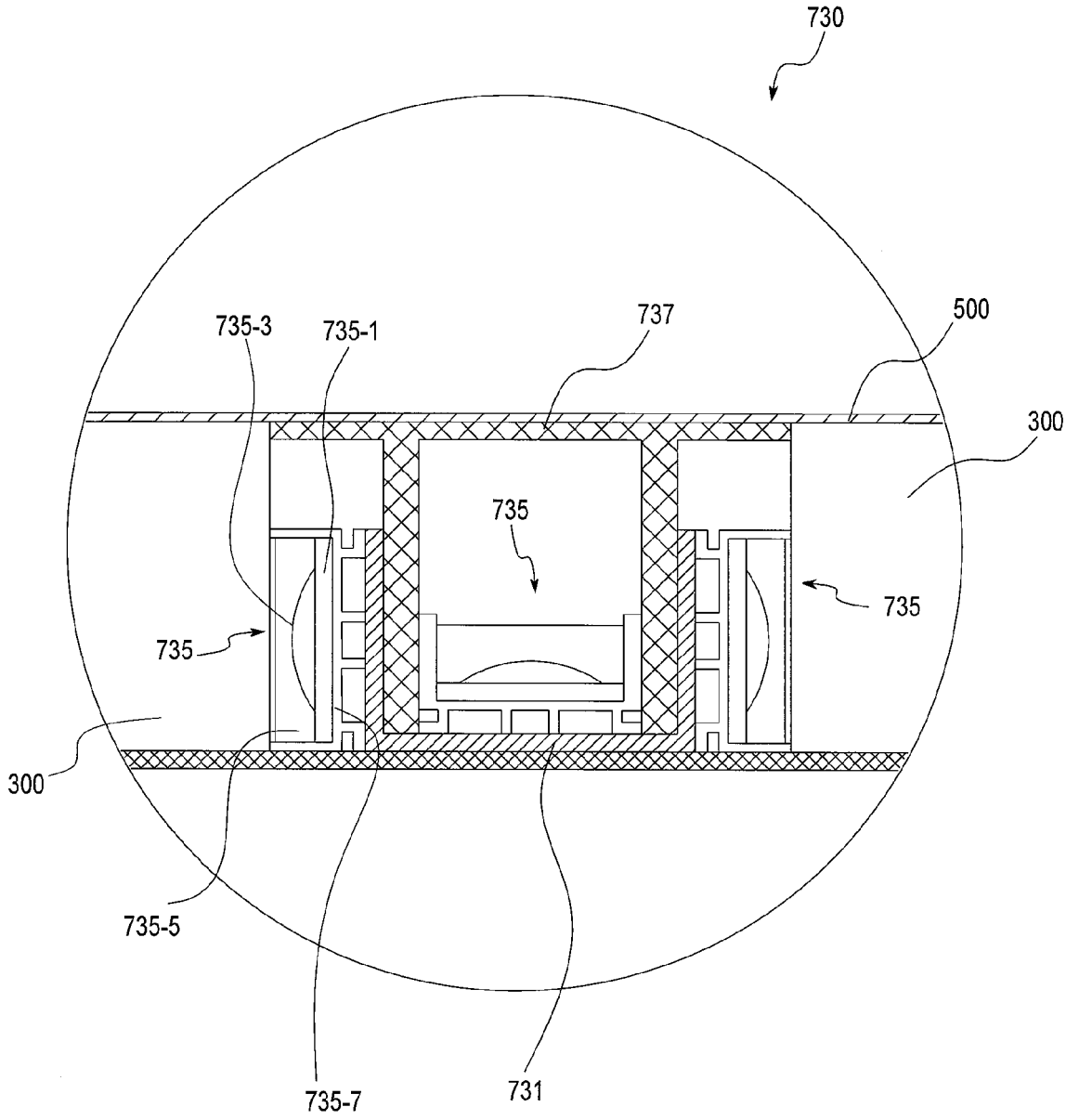
FIG. 3 illustrates a detailed sectional view of the illuminated sign apparatus of FIG. 2 in accordance with embodiments of the invention.

With reference to FIG. 3, light sources 735 may comprise a substrate 735-1 and one or more light emitters 735-3, molded by a transparent epoxy 735-5 or a silicon material of a certain length in order to prevent electric leakage resulting from moisture ingress, e.g., from rain water or condensation. Light emitters 735-3 may comprise one or more LEDs. Light emitters 735-3, substrate 735-1 and epoxy 735-5 may be disposed in a heat radiating channel 735-7. Heat radiating channel 735-7 may comprise one or more fins for dissipating heat and may be constructed of aluminum or other heat conductive materials. Heat radiating channel 735-7 may have a U-shaped profile.

Figure 4:
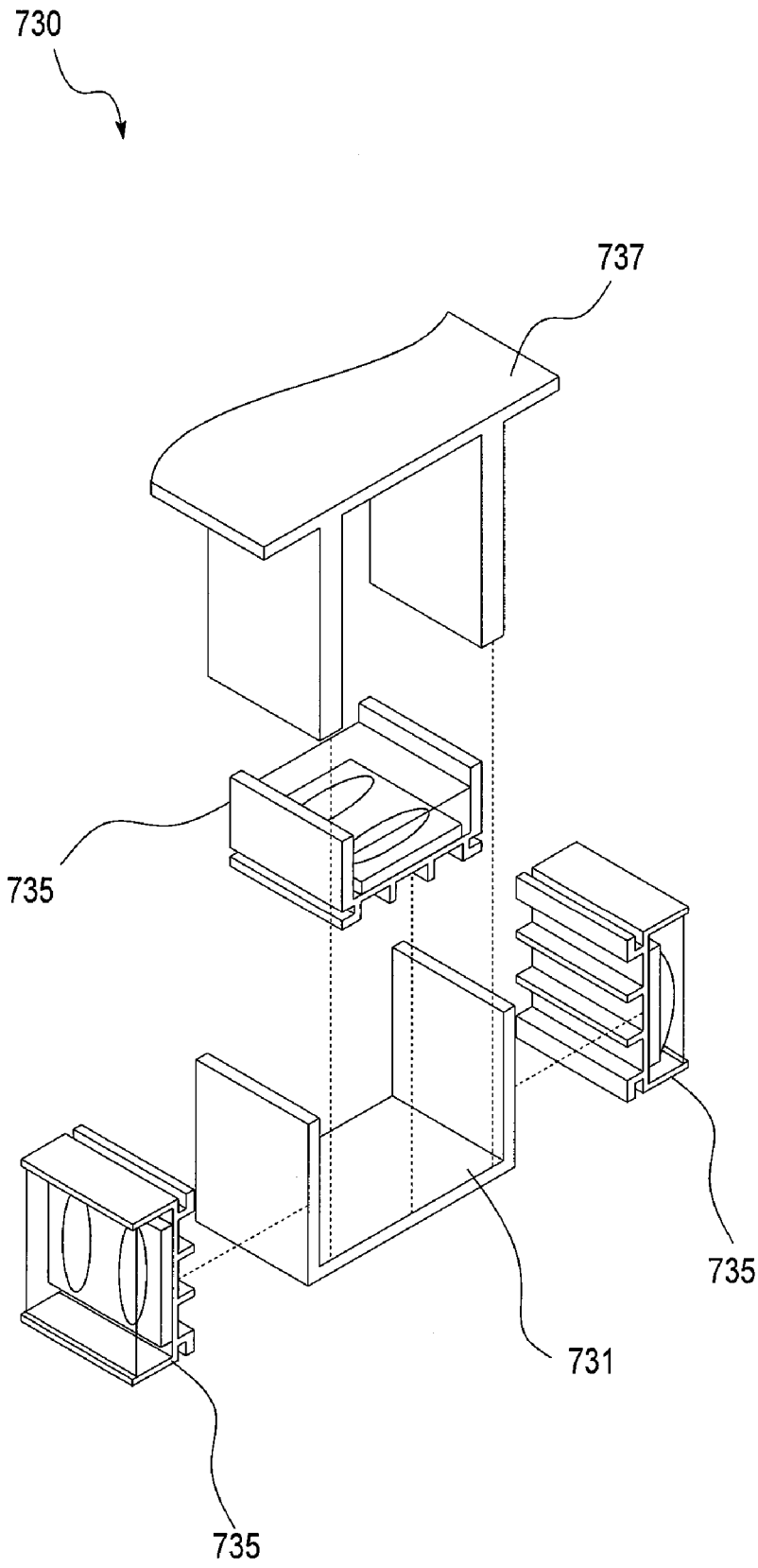
FIG. 4 illustrates an exploded perspective view of a detail inset of the illuminated sign apparatus of FIG. 2 in accordance with embodiments of the invention.

As illustrated in detail 730 in FIGS. 3 and 4, interior light emitting insertion areas 700 may include U-shaped heat radiating plate 731, light sources 735 and transparent cover 737. Interior light emitting units 735 are disposed to emit light into edges of adjacent light guide plates 300 and in a generally transverse direction into visual content sheet 500. Transparent cover 737 may cover the open portion of heat radiating plate 731 and be positioned at a connection portion of adjoining light guide plates 300.

Since they are slidably insertable and slidably removable between frame 100 and light guide plate 300 or between light guide plates 300, ease of assembly is facilitated and light emitting units 735 can also be easily exchanged when damaged or requiring maintenance.

Side light emitting units 735 as illustrated in detail 710 may emit light at a sign edge portion and, as shown in detail 730, interior light emitting unit 735 may emit light from an interior area of the sign. Thus, in accordance with embodiments of the invention, seamless and/or uniform backlighting is provided to visual content sheet 500 so that the informational content is perceivable under various environmental conditions.

Figure 5:
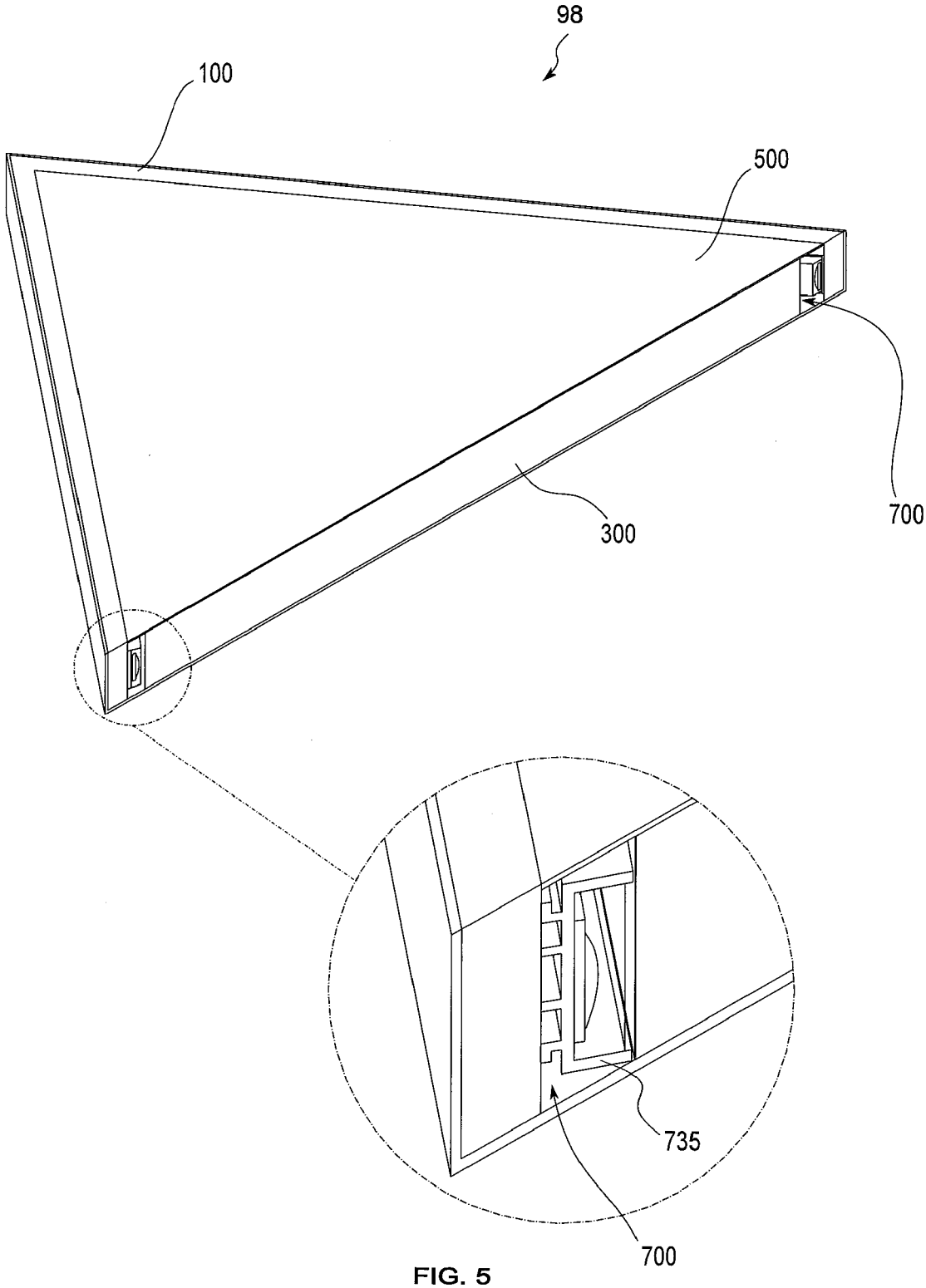
FIGS. 5 and 6 illustrate alternate embodiments of sign apparatuses in accordance with embodiments of the invention.
Figure 6:
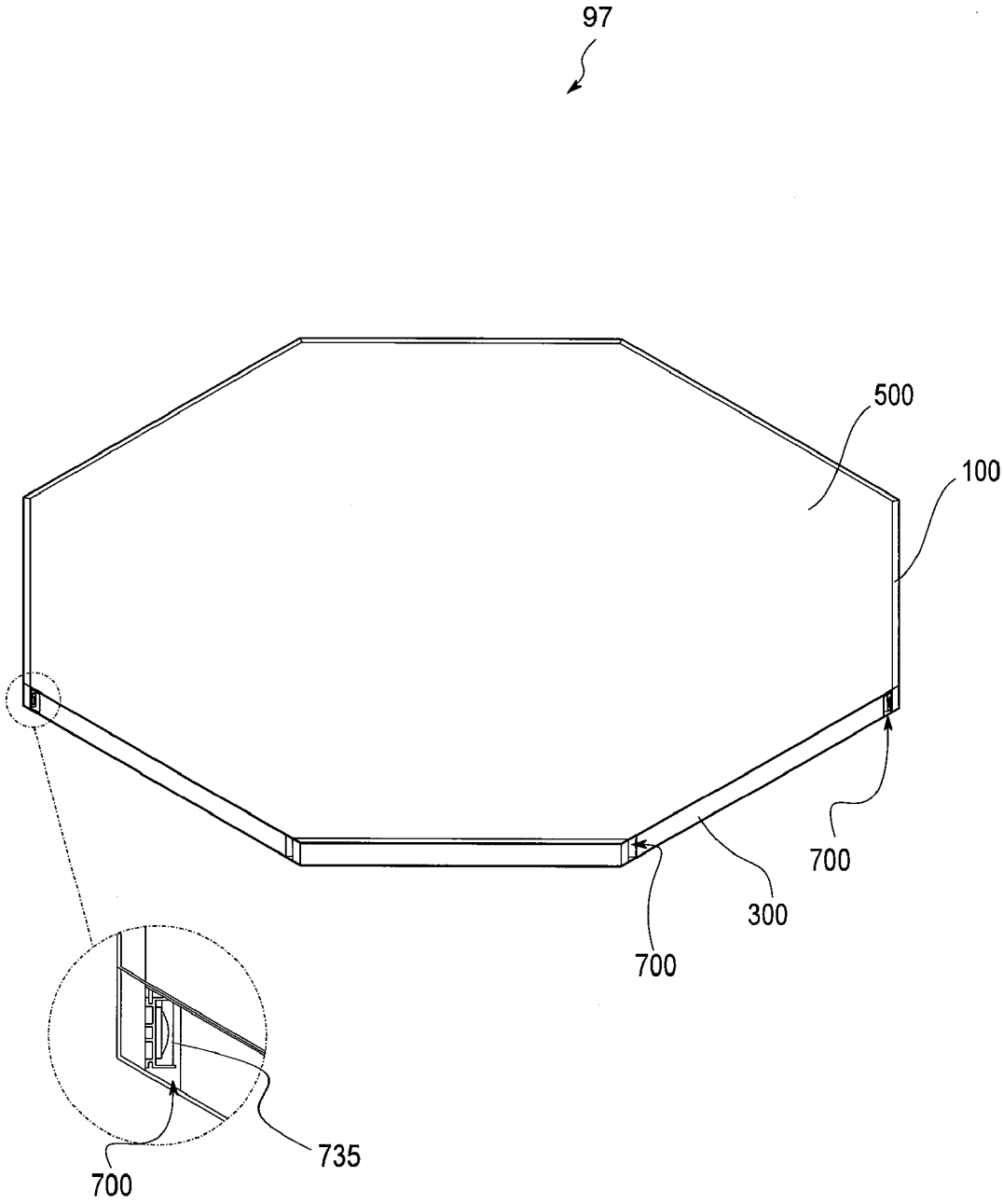

With reference to FIG. 5, a backlighted sign 98 is provided. Backlighted sign 98 has a similar constitution to backlighted sign 99 with frame 100, one or more light guide plates 300, one or more slidably insertable light emitting units 735, one or more light emitting unit insertion areas 700 and visual content sheet 500. Backlighted sign 98, however, is triangle-shaped. With reference to FIG. 6, a backlighted sign 97 is provided. Backlighted sign 97 has a similar constitution to backlighted signs 98 and 99 with frame 100, one or more light guide plates 300, one or more slidably insertable light emitting units 735, one or more light emitting unit insertion areas 700 and visual content sheet 500. Backlighted sign 97, however, is octagon-shaped. Backlighted signs 97 and 98 may comprise multiple light emitting units 735 disposed along one or more edges thereof. Optionally, backlighted signs 97 and 98 may have light emitting units 735 disposed in an interior region (not shown), in a manner similar to that illustrated in FIG. 3.

Thus, according to embodiments of the invention, it is possible to uniformly and/or seamlessly backlight an arbitrarily large visual content sheet 500 so information thereon may be easily recognized.

While various embodiments of the present invention have been described above, it should be understood that they have been presented by way of example only, and not limitation. For example, the present invention is not limited to signs having rectangular, triangular or octagonal shapes. Thus, the breadth and scope of the present invention should not be limited by any of the above-described exemplary embodiments.

What is claimed is:

1. A backlighted sign comprising:

a light emitting assembly comprising:

a first light emitting unit configured to emit light in a first direction into an edge of a first adjacent light guide plate;

a second light emitting unit configured to emit light in a second direction opposite the first direction into an edge of a second adjacent light guide plate; and a third light emitting unit configured to emit light in a direction substantially transverse to the first and second directions into a backlightable sign panel;

the first and second adjacent light guide plates; and a backlightable visual content panel;

wherein one or more of the light emitting units has an installed position wherein said one or more light emitting units is disposed between the first and second adjacent light guide plates and behind the backlightable visual content panel and wherein said one or more of light emitting units are configured to be slidably insertable and slidably removable from the installed position.

2. The light emitting assembly of claim 1, wherein at least one of the first, second and third light emitting units comprises a light emitting diode.

3. The light emitting assembly of claim 1, further comprising transparent molding disposed on at least one of the first, second and third light emitting units, said molding arranged to prevent water ingress upon an electrical component of the light emitting unit and comprising a material selected from the group consisting of transparent epoxy and a silicone-based compound.

4. The light emitting assembly of claim 3, wherein said at least one light emitting unit further comprises a heat sink, said transparent molding disposed within said heatsink.

5. The light emitting assembly of claim 4, wherein the heat sink has a substantially U-shaped profile.

6. The light emitting assembly of claim 1, further comprising a second heat sink with a substantially U-shaped profile, wherein the first and second light emitting units are disposed on opposite sides of the second heat sink and are oriented to direct light in opposite directions, further wherein the third light emitting unit is disposed within the second heat sink and oriented to direct light toward the opening of the second heat sink.

7. The light emitting assembly of claim 6, further comprising a light transmitting cover disposed along the sides and over the opening of the second heat sink, said light transmitting cover configured to transmit light emitted from the third light emitting unit.

8. The backlighted sign of claim 1 further comprising:

a frame; and one or more edge light emitting assemblies configured and arranged to emit light into at least one edge of the first and/or second adjacent light guide plates.

* * * * *